US010819060B2

(12) United States Patent
Tsukiyoshi et al.

(10) Patent No.: US 10,819,060 B2
(45) Date of Patent: Oct. 27, 2020

(54) STACKED CONNECTOR

(71) Applicant: Sumitomo Wiring Systems, Ltd., Yokkaichi, Mie (JP)

(72) Inventors: Keiichi Tsukiyoshi, Mie (JP); Yuto Harada, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/660,859

(22) Filed: Oct. 23, 2019

(65) Prior Publication Data

US 2020/0136300 A1 Apr. 30, 2020

(30) Foreign Application Priority Data

Oct. 24, 2018 (JP) ..... 2018-199640

(51) Int. Cl.

| | |
|---|---|
| ***H01R 13/502*** | (2006.01) |
| ***H01R 13/506*** | (2006.01) |
| ***H01R 13/424*** | (2006.01) |
| ***H01R 24/20*** | (2011.01) |
| ***H01R 43/20*** | (2006.01) |
| *H01R 107/00* | (2006.01) |

(52) U.S. Cl.

CPC ..... *H01R 13/506* (2013.01); *H01R 13/424* (2013.01); *H01R 24/20* (2013.01); *H01R 43/20* (2013.01); *H01R 2107/00* (2013.01)

(58) Field of Classification Search

CPC .... H01R 13/506; H01R 13/424; H01R 24/20; H01R 43/20; H01R 2107/00; H01R 13/4223; H01R 13/4361; H01R 13/514

USPC ..... 439/687

See application file for complete search history.

(56) References Cited

U.S. PATENT DOCUMENTS

| | | | | |
|---|---|---|---|---|
| 2002/0081828 | A1* | 6/2002 | Tanaka | H01R 13/4226 438/595 |
| 2007/0072492 | A1* | 3/2007 | Kobayashi | H01R 13/4361 439/701 |
| 2012/0225576 | A1* | 9/2012 | Kida | H01R 13/641 439/345 |
| 2017/0237196 | A1* | 8/2017 | Matsui | H01R 13/506 439/638 |
| 2017/0346230 | A1* | 11/2017 | Imai | H01R 33/7671 |
| 2019/0103698 | A1* | 4/2019 | Takagi | H01R 13/518 |
| 2019/0267746 | A1* | 8/2019 | Chikusa | H01R 13/4223 |
| 2019/0273337 | A1* | 9/2019 | Matsuura | H01R 13/4223 |

(Continued)

FOREIGN PATENT DOCUMENTS

JP 2006-294580 10/2006

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

A stacked connector includes a first housing (10A) and a second housing (10B) to be stacked one on the other. The first and second housings (10A, 10B) respectively include first detecting portions (17A) and second detecting portions (17B) configured to interfere with incompletely inserted second terminal fittings (60B) and first terminal fittings (60A) on a first facing surface (11A) and a second facing surface (11B). The first housing (10A) is recessed with groove portions (35) formed in an outer side surface opposite to the first facing surface (11A) by cutting a region along a width direction, extending in a depth direction, and open on both ends in the depth direction.

3 Claims, 9 Drawing Sheets

(56) References Cited

U.S. PATENT DOCUMENTS

| | | | | |
|---|---|---|---|---|
| 2019/0288447 | A1* | 9/2019 | Shimizu | H01M 10/425 |
| 2019/0334152 | A1* | 10/2019 | Shimizu | H01M 2/1077 |
| 2020/0136295 | A1* | 4/2020 | Tsukiyoshi | H01R 13/436 |
| 2020/0136300 | A1* | 4/2020 | Tsukiyoshi | H01R 43/20 |

* cited by examiner

STACKED CONNECTOR

BACKGROUND

Field of the Invention

The invention relates to a stacked connector.

Related Art

Japanese Unexamined Patent Publication No. 2006-294580 discloses a connector with two housings to be stacked on and united with each other. Connector housing locking means are disposed on both end parts in a width direction intersecting a stacking direction and are configured for holding the connector housings in a united state. Detecting portions project from a facing surface of one connector housing facing a facing surface of the other connector housing and interfere with terminal fittings accommodated in the other connector housing to detect an incompletely inserted state of the terminal fittings.

Interference of the detecting portion of the one connector housing with the incompletely inserted terminal fitting restricts the entrance of the detecting portion into the other connector housing. Thus, a clearance is formed between the facing surfaces of the connector housings at a position where the incompletely inserted terminal fitting and the detecting portion interfere.

A clearance between the facing surfaces of the connector housings increases a dimension between outer side surfaces opposite to the facing surfaces of the connector housings beyond a specified dimension. Thus, the interference of the incompletely inserted terminal fitting and the detecting portion can be known by confirming that the dimension between the outer side surfaces is larger than the specified dimension.

The dimension between the outer side surfaces of the connector housings with a tool (see reference sign 80 of FIGS. 8 and 9 although shown in an embodiment) that has two opposed parallel surfaces that are spaced apart by a width corresponding to the specified dimension between the outer side surfaces of the connector housings. An inability to insert the connector into the tool indicates that the dimension between the outer side surfaces of the connector housings is larger than the specified dimension.

However, the detecting portion may receive an excessive reaction force from an incompletely inserted terminal fitting and may be squeezed. The squeezed detecting portion may narrow the clearance between the facing surfaces of the connector housings sufficiently to permit insertion of the connector into the tool. Consequently, the incompletely inserted state of the terminal fitting may not be detected.

The invention was completed on the basis of the above situation and aims to provide a connector with improved reliability in detecting incomplete insertion of a terminal fitting.

SUMMARY

The invention relates to a stacked connector with two housings to be stacked on one another. Each housing has a facing surface facing the other housing in a stacking direction. At least one of the facing surfaces has a detecting portion configured to project toward a cavity of the other housing and to detect a terminal fitting incompletely inserted into the cavity. Additionally, at least one of the housings has a groove formed in an outer side surface opposite to the facing surface by cutting a region along a width direction intersecting the stacking direction. The groove extends in a depth direction intersecting the stacking direction and the width direction. The groove is open on both sides in the depth direction.

Interference of the detecting portion with the incompletely inserted terminal fitting causes one of the housings to deform and curve in the width direction with the groove as a starting point, thereby causing a dimension between outer side surfaces of the housings to exceed the specified dimension. Thus, the stacked connector cannot be inserted into a tool having two parallel surfaces and reliability in detecting incomplete insertion of the terminal fitting can be improved.

A rib may extend in the width direction, and a plurality of the grooves may be provided at intervals in the width direction on an outer side surface of the rib. According to this configuration, the housing is deformed more easily, and the insertion of the stacked connector into the tool is restricted more reliably, thereby improving the reliability of detecting incomplete insertion of the terminal fitting.

DETAILED DESCRIPTION

An embodiment is described with reference to FIGS. 1 to 9. A stacked connector of this embodiment includes a first housing 10A and a second housing 10B to be stacked one on the other. First terminal fittings 60A and second terminal fittings 60B are to be accommodated respectively into the first and second housings 10A, 10B. In the following description, a left side of FIGS. 2 and 4 is referred to as a front concerning a front-rear direction and a vertical direction is based on a vertical direction of the figures except FIG. 7.

Figure 6:
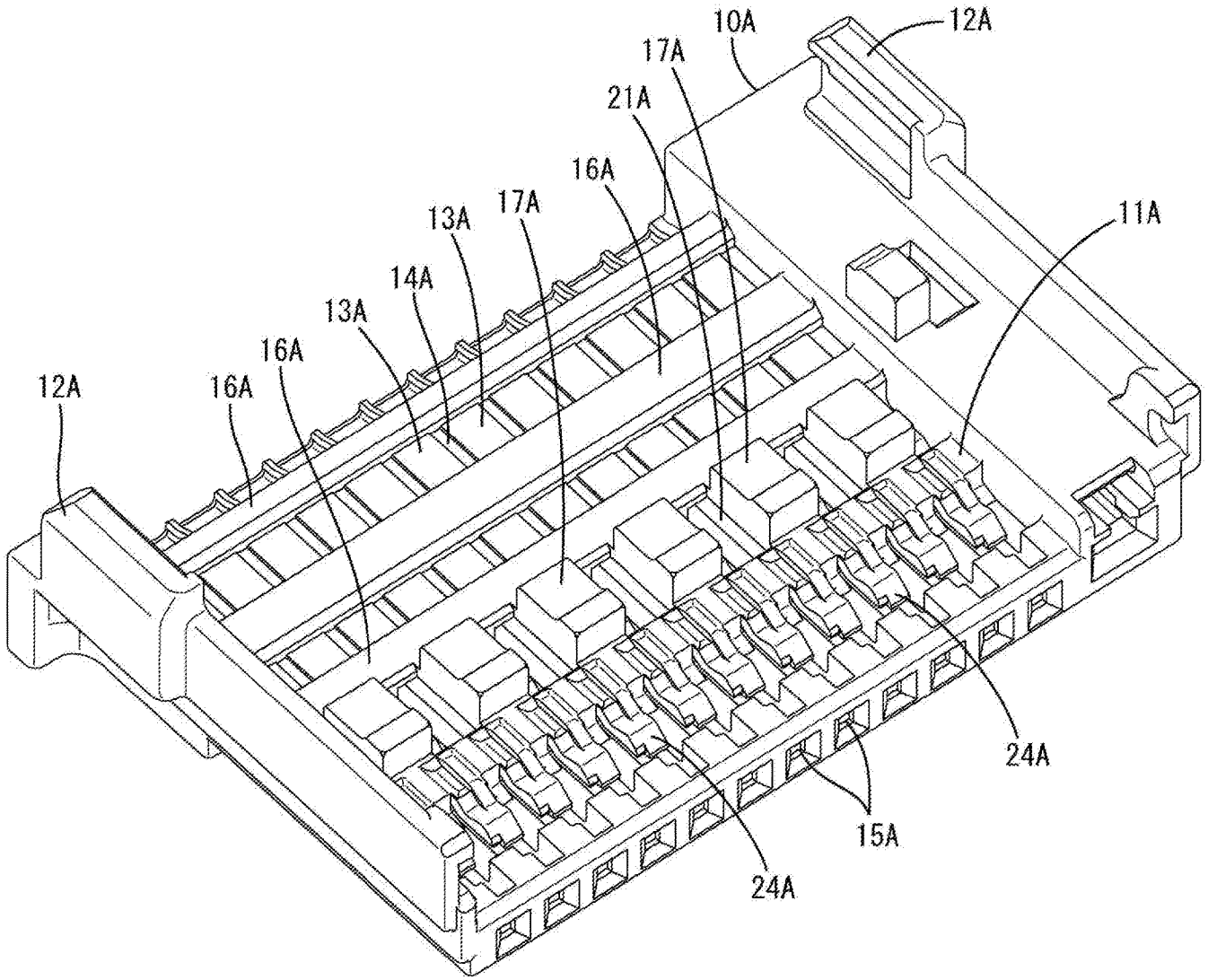
FIG. 6 is a perspective view of the first housing viewed from above.

The first housing 10A is a lower housing and, as shown in FIG. 6, has a flat shape with a width direction intersecting a vertical direction (stacking direction) as a longitudinal direction and has a first facing surface 11A facing the second housing 10B as a stacking partner on an upper surface. The first housing 10A includes first housing locks 12A in the form of plates extending along the front-rear direction on both widthwise sides.

The first housing 10A includes first cavities 13A into which the first terminal fittings 60A are insertable. The respective first cavities 13A are arranged in a row in the width direction while being partitioned by first partition walls 14A.

A front wall of the first housing 10A includes first insertion openings 15A communicating with the respective first cavities 13A. Tabs of unillustrated mating first terminals mounted in a mating connector are inserted through the respective first insertion openings 15A and into the corresponding first cavities 13A when the stacked connector is connected to the mating connector.

As shown in FIG. 6, the first housing 10A includes first bridges 16A extending across the respective first cavities 13A in the width direction and coupled to the upper ends of the first partition walls 14A on the first facing surface 11A. The first bridges 16A are strips provided at intervals in the front-rear direction.

First detecting portions 17A are connected to a front part of the first bridge 16A, which is arranged in a substantially central part in the front-rear direction. The first detecting portions 17A project from the first facing surface 11A of the first housing 10A and are coupled to the upper end of every other one of the first partition walls 14A that are arranged in the width direction. As shown in FIG. 2, each first detecting portion 17A is a rectangular block with a first detecting surface 18A extending along the front-rear direction on an upper surface and a first retaining surface 19A extending along the vertical direction on a front surface. As described later, the first detecting portion 17A functions to detect an incompletely inserted state of the second terminal fittings 60B accommodated in the second housing 10 as the stacking partner and retaining the second terminal fittings 60B.

Figure 3:
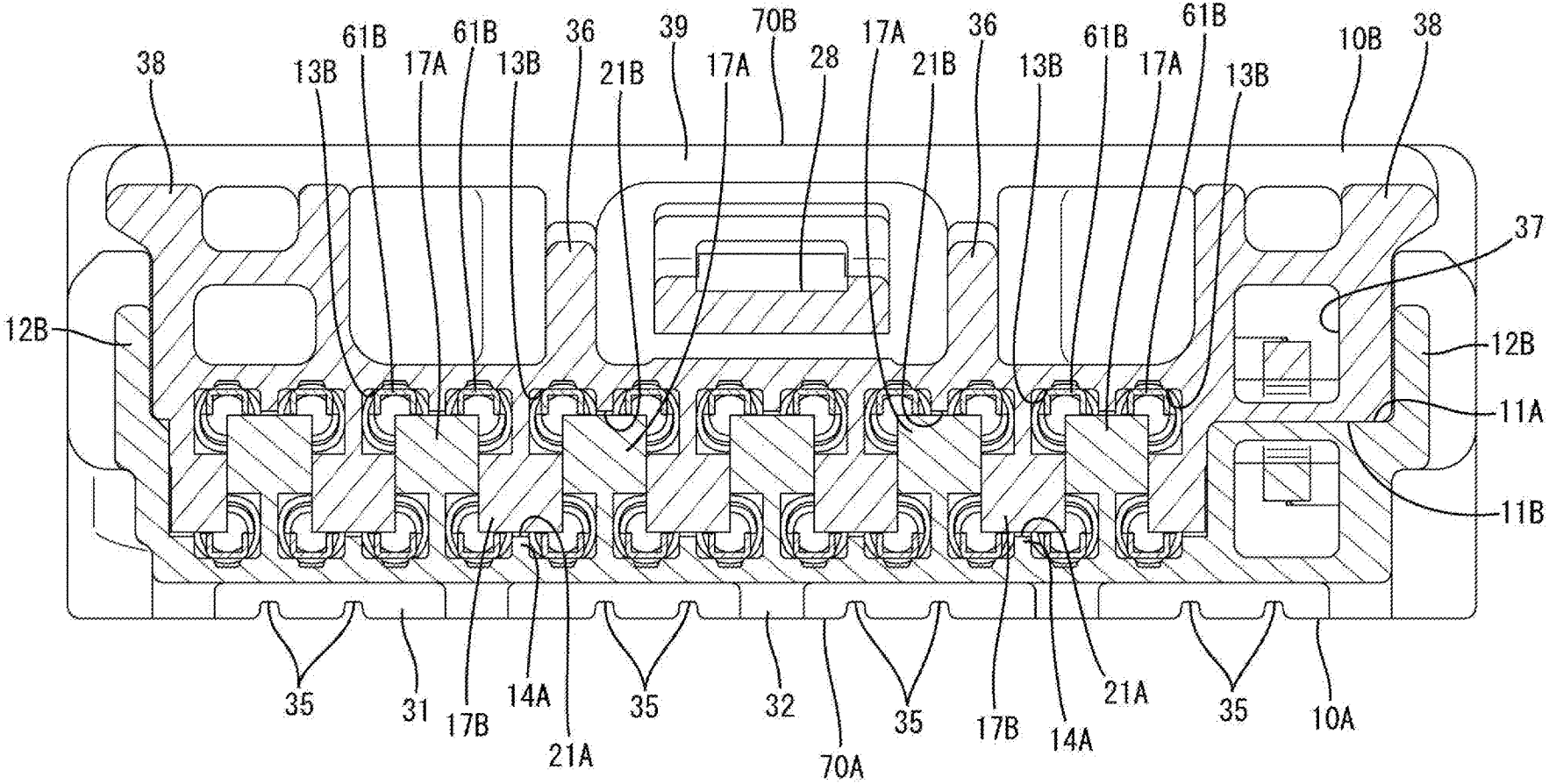
FIG. 3 is a section along X-X of FIG. 2.
Figure 4:
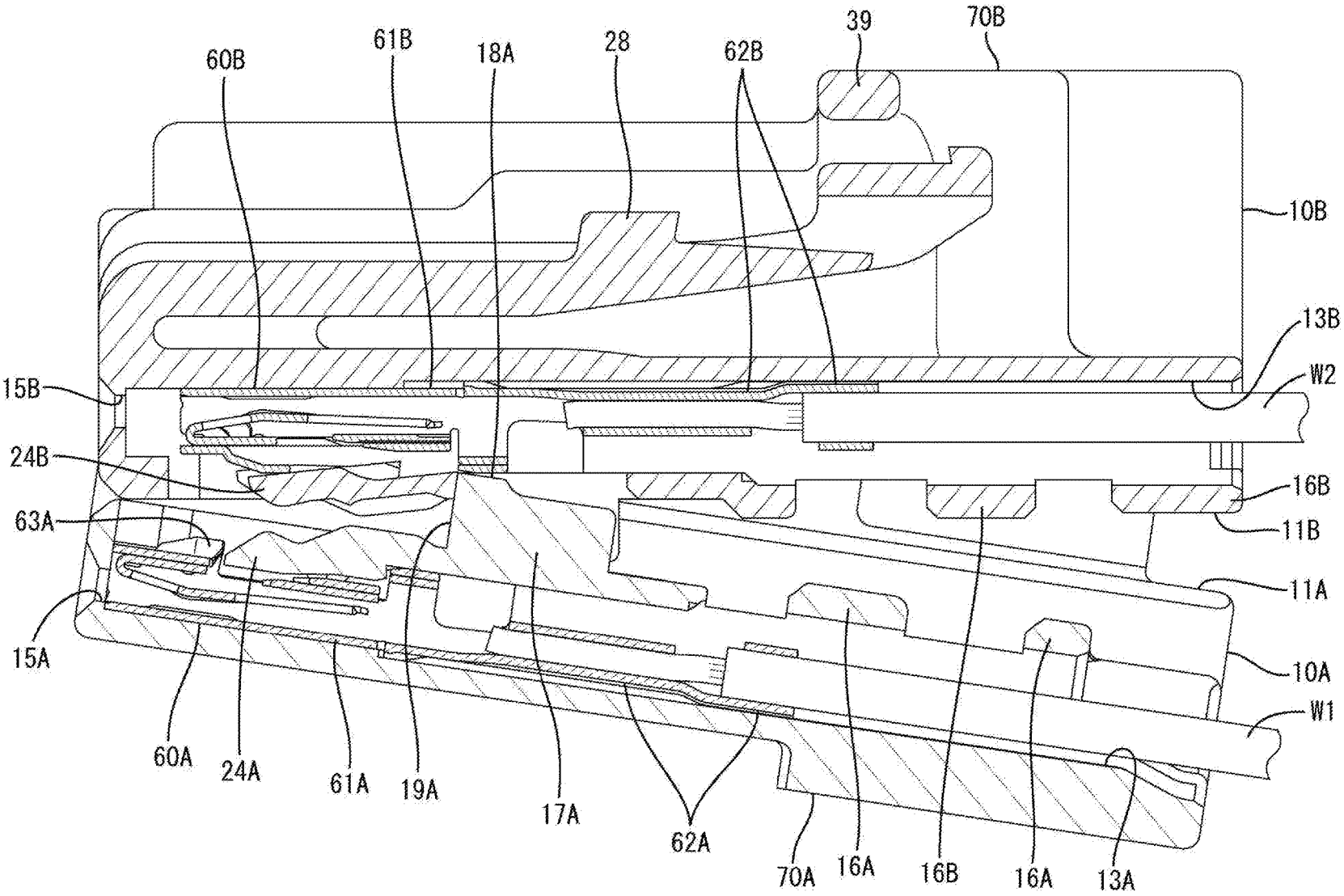
FIG. 4 is a side view in section when a first detecting portion interferes with a second terminal fitting in an incompletely inserted state.

As shown in FIG. 3, every other one of the first partition walls 14A has no first detecting portion 17A coupled thereto and includes a first recess 21A slightly dropped from front and rear adjacent parts on an upper end between the adjacent first detecting portions 17A. A second detecting portion 17B to be described later can enter the first recess 21A.

First locking lances 24A are cantilevered forward from front ends of the first detecting portions 17A at positions corresponding to the respective first cavities 13A. Each first locking lance 24A is entirely exposed in the first facing surface 11A. As shown in FIG. 2, the first locking lance 24A resiliently locks the first terminal fitting 60A inserted into the first cavity 13A and retains the first terminal fitting 60A.

Figure 5:
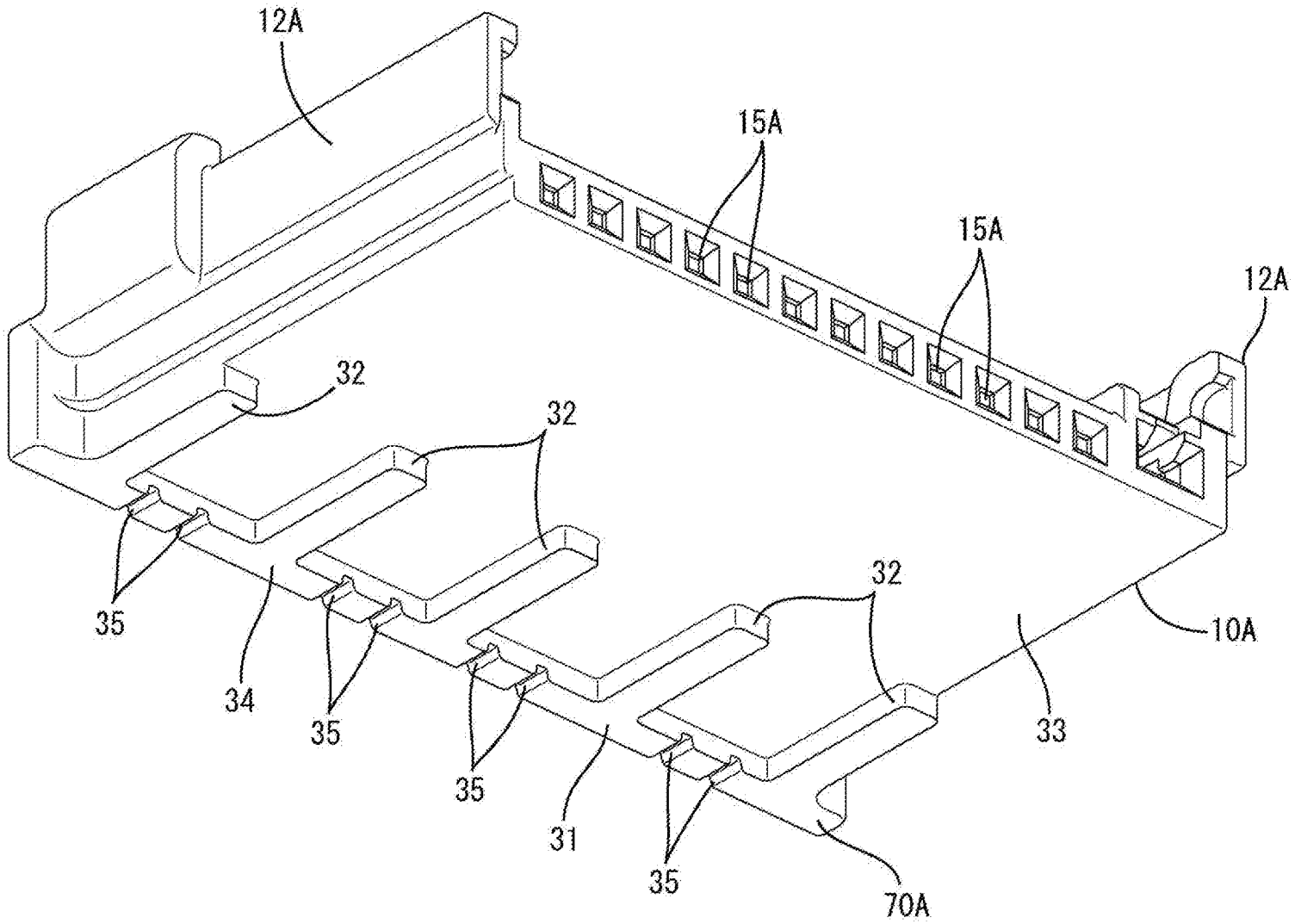
FIG. 5 is a perspective view of a first housing viewed from below.

As shown in FIG. 5, a rib 31 is formed on a rear end part of the lower surface of the first housing 10A and extends over the entire width. Crossing ribs 2 extend rearward from laterally spaced positions on the rib 31. Any of the rib 31 and the crossing ribs 32 has a rectangular cross-sectional shape, and the rib 31 and the crossing ribs 32 are perpendicular to each other. A region of the lower surface of the first housing 10A excluding the rib 31 and the crossing ribs 32 is a flat surface 33 that is flat along the front-rear direction and the width direction. The lower surface of the rib 31 and those of the crossing ribs 32 are connected to each other without any step, and constitute an end surface 34 flat along the front-rear direction and the width direction similarly to the flat surface 33. The flat surface 33 and the end surface 34 constitute an outer side surface opposite to the first facing surface 11A.

As shown in FIG. 5, grooves 35 are recessed at positions spaced apart in the width direction on the end surface 34 of the rib 31. Each groove 35 has a rectangular cross-sectional shape and has the same shape. The grooves 35 extend in the front-rear direction and are open in the front and rear surfaces of the rib 31. The grooves 35 are arranged in pairs between the crossing ribs 32 that are adjacent in the width direction. The rear surface of the rib 31 is also the rear surface of the first housing 10A, and each groove 35 is open in the rear surface of the first housing 10A. The rigidity of the rib 31 on the side of the end surface 34 is reduced by the grooves 35. The rib 31 and, eventually, the first housing 10A are resiliently deformable to curve in the width direction with each groove 35 as a starting point. Note that if the first housing 10A is not provided with the rib 31, it is difficult to ensure a predetermined strength for the first housing 10A.

The first terminal fitting 60A is formed by bending a conductive metal plate. As shown in FIG. 2, a rectangular tubular first body 61A is formed in a front part of the first terminal fitting 60A. A first barrel 62A is provided behind the first body 61A and is to be connected electrically and mechanically to an end part of a wire W1. A locking protrusion 63A bulges up on an upper surface of the first body 61A.

Figure 7:
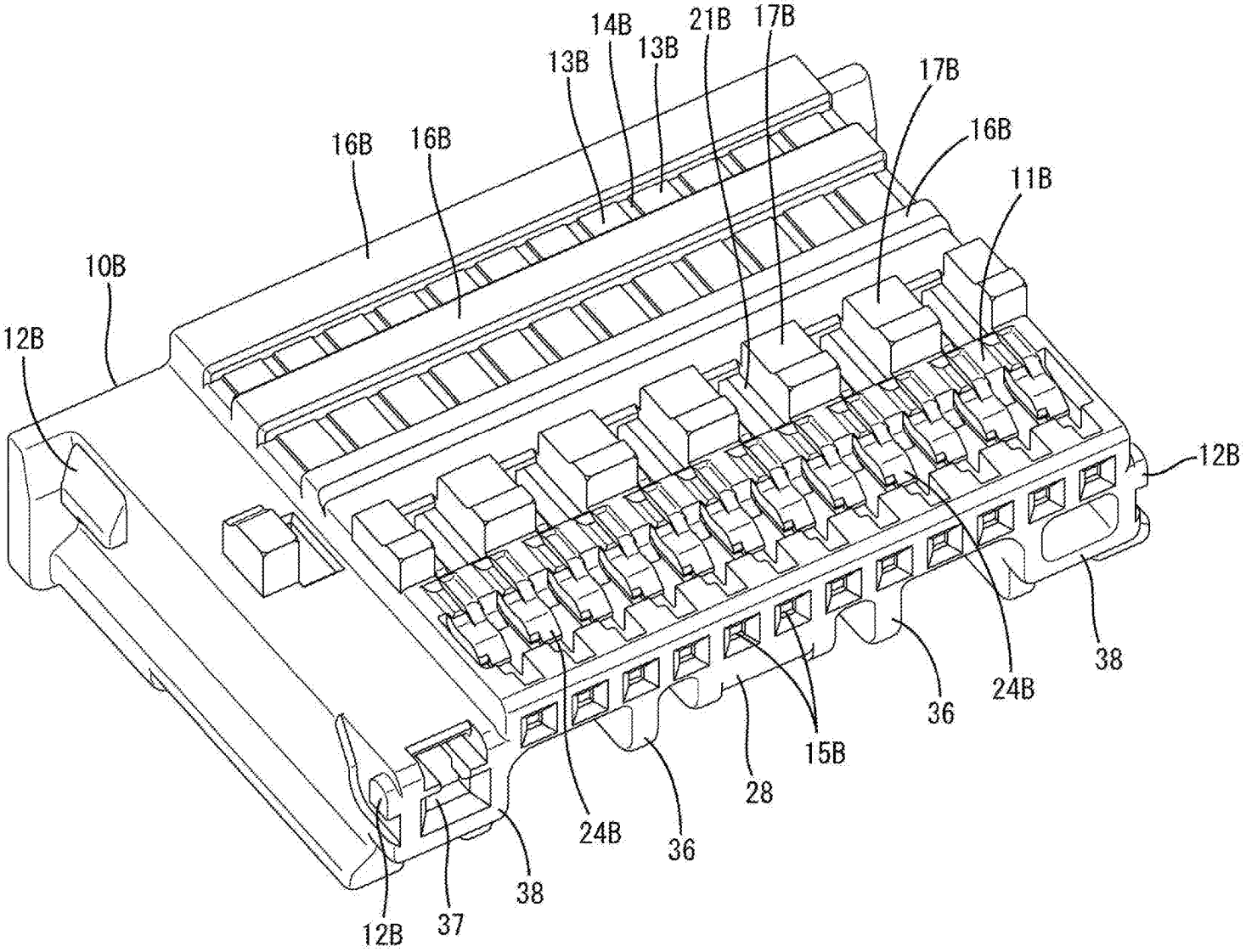
FIG. 7 is a perspective view of a second housing viewed from below.

The second housing 10B is an upper housing and, as shown in FIG. 7, has a flat shape with the width direction as a longitudinal direction and includes a second facing surface 11B facing the first housing 10A as a stacking partner on a lower surface.

Figure 1:
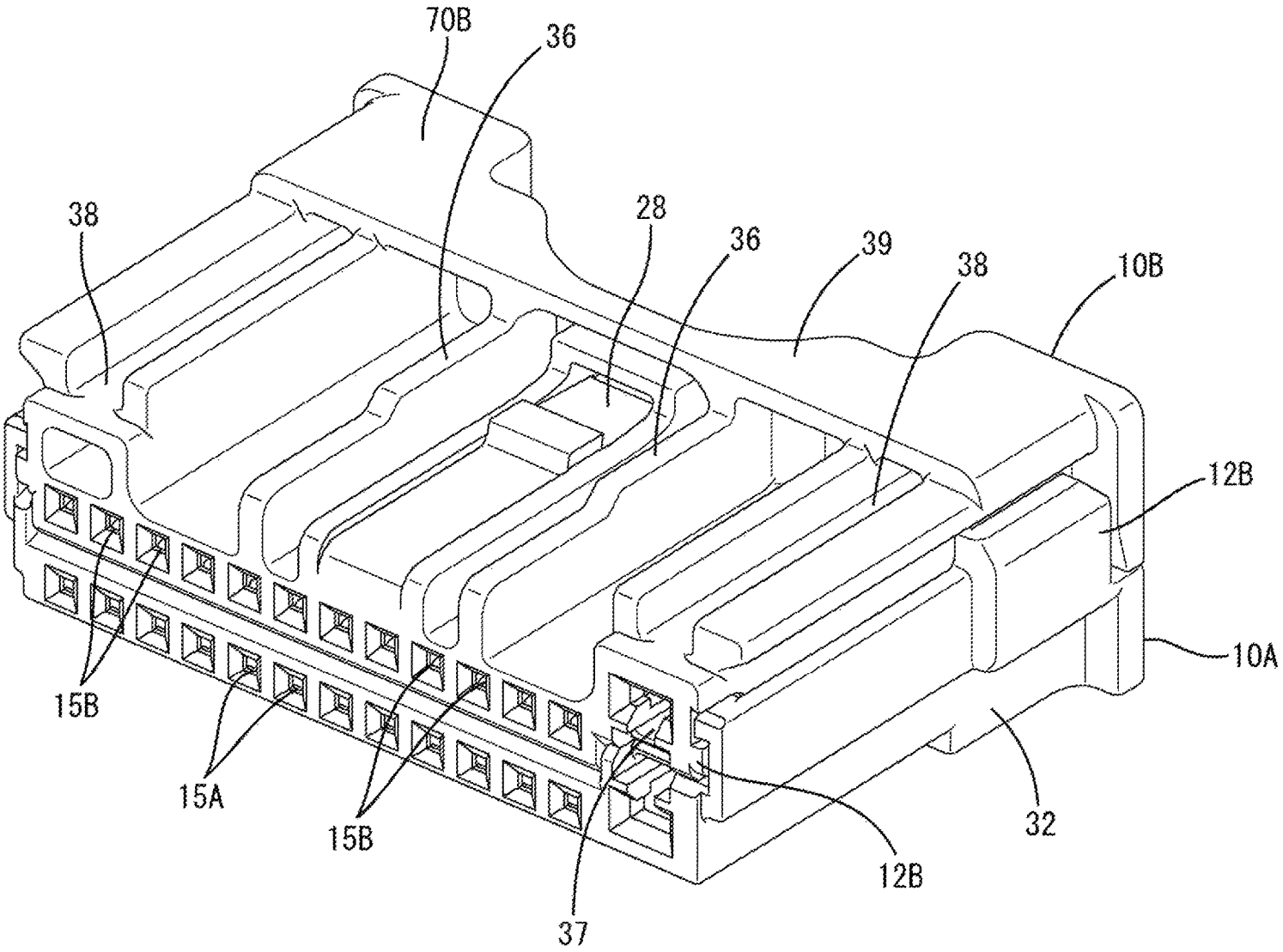
FIG. 1 is a perspective view of a stacked connector of an embodiment of the invention.
Figure 2:
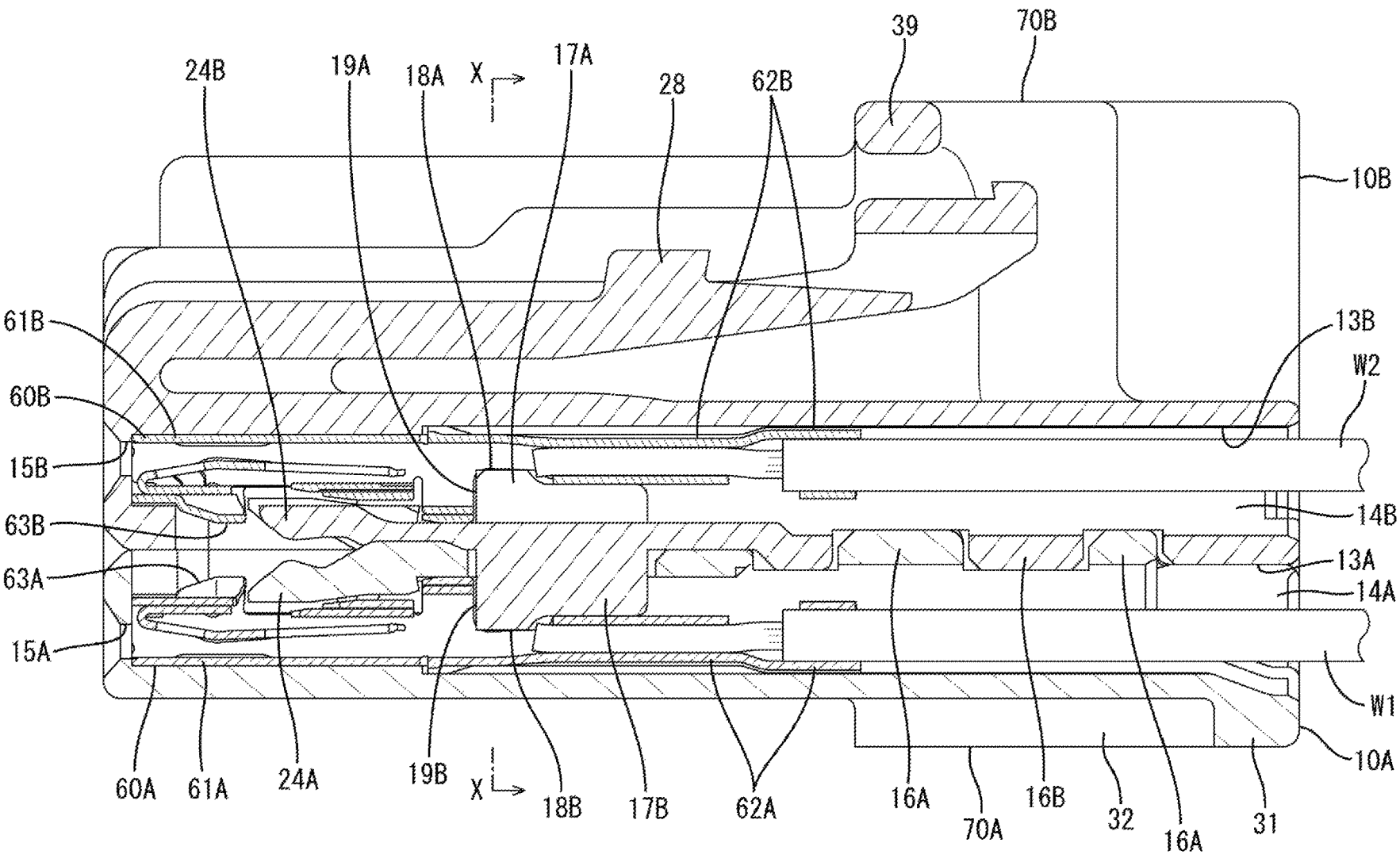
FIG. 2 is a side view in section of the stacked connector.

As shown in FIG. 1, the second housing 10B includes a deflectable lock arm 28 cantilevered in a widthwise central part of the upper surface. As shown in FIG. 7, the second housing 10B includes second housing locks 12B spaced apart in the front-rear direction on both widthwise end parts. The second housing locks 12B are locked resiliently to the corresponding first housing locks 12A to hold the first housing 10A and the second housing 10B in a united state. The first housing 10A and the second housing 10B that are held in the united state can be connected to the mating connector. Thus, the lock arm 28 resiliently locks the mating connector to hold the first housing 10A and the second housing 10B inseparably from the mating connector.

As shown in FIG. 1, two protection walls 36 stand on both sides across the lock arm 28 in the width direction and tubular surrounding portions 38 surrounding large-size cavities 37 stand on both widthwise end parts on the upper surface of the second housing 10B. Further, the second housing 10B includes a covering wall 39 bridged between upper end parts of the respective tubular surrounding portions 38 and coupled to upper end rear parts of the respective protection walls 36. The covering wall 39 restricts the action of an unnecessary unlocking force on the lock arm 28. In this way, an upper surface side of the second housing 10B is reinforced firmly by the lock arm 28, the protection walls 36, the tubular surrounding portions 38 and the covering wall 39. Thus, unlike the first housing 10A, the second housing 10B is not structured to be deformed and curved in the width direction.

The second housing 10B includes second cavities 13B similar to the first cavities 13A, second partition walls 14B similar to the first partition walls 14A, second insertion openings 15B similar to the first insertion openings 15A, second bridges 16B similar to the first bridges 16A, second detecting portions 17B similar to the first detecting portions 17A, second recesses 21B similar to the first recesses 21A and second locking lances 24B similar to the first locking lances 24A. As shown in FIG. 2, the second detecting portion 17B has a second retaining surface 19B similar to the first retaining surface 19A and a second detecting surface 18B similar to the first detecting surface 18A.

The parts of the second housing 10B are oriented to be vertically opposite to corresponding parts of the first housing 10A. When the first housing 10A and the second housing 10B are in the united state, the second bridges 16B are fit in front of or behind the first bridges 16A (see FIG. 2), the second detecting portions 17B are in the first recesses 21A and the first detecting portions 17A are in the second recesses 21B (see FIG. 3). The first and second bridges 16A, 16B are meshed in the front-rear direction and the first and second detecting portions 17A, 17B are meshed in the width direction, thereby restricting positional deviations of the united first and second housings 10A, 10B along the first and second facing surfaces 11A, 11B. Further, when the first and second housings 10A, 10B are united, the first locking lances 24A and the second locking lances 24B are arranged at the same intervals in the width direction and are arranged back-to-back with each other.

The second terminal fitting 60B has the same shape as the first terminal fitting 60A and, as shown in FIG. 2, is connected to an end part of a wire W2, inserted in a posture vertically inverted from that of the first terminal fitting 60A into the second cavity 13B and locked by the second locking lance 24B. The second terminal fitting 60B includes a second body 61B similar to the first body 61A, a second barrel 62B similar to the first barrel 62A and a second locking protrusion 63B similar to the first locking protrusion 63A.

Next, an assembling method and functions of the stacked connector of this embodiment are described.

During assembly, the first terminal fittings 60A are inserted into the first cavities 13A of the first housing 10A from behind. The first locking lance 24A contacts the rear end of the first locking protrusion 63A when the first terminal fitting 60A is inserted properly into the first cavity 13A, thereby achieving primary locking and retention of the first terminal fitting 60A in the first cavity 13A. Similarly, the second terminal fittings 60B are inserted into the second cavities 13B of the second housing 10B to achieve primary locking and retention by the second locking lances 24B.

Subsequently, the first and second facing surfaces 11A, 11B are caused to face each other in the vertical direction and, in that state, the first and second housings 10A, 10B are brought closer to and united with each other. Each first detecting portion 17A enters the corresponding second recess 21B if the second terminal fittings 60B are inserted properly in the second cavities 13B. Each first detecting portion 17A is located to correspond to two second terminal fittings 60B inserted into the second cavities 13B adjacent across that second recess 21B. Thus, the first retaining surface 19A of the first detecting portion 17A is arranged to contact and lock the second bodies 61B of the two second terminal fittings 60B from behind (see FIGS. 2 and 3). Similarly, each second detecting portion 17B enters the corresponding first recess 21A if the first terminal fittings 60A are inserted properly in the first cavities 13A. Each second detecting portion 17B is located to correspond to two first terminal fittings 60A inserted into the first cavities 13A adjacent across that first recess 21A. Thus, the second retaining surface 19B of the second detecting portion 17B is arranged to contact and lock the first bodies 61A of the two first terminal fittings 60A from behind. In this way, the first and second terminal fittings 60A, 60B achieve reliably secondary retention in the first and second cavities 13A, 13B. The first housing locks 12A and the second housing locks 12B of the properly united first and second housings 10A, 10B are locked to each other on both widthwise sides (see FIG. 1).

On the other hand, if the first terminal fitting 60A is not inserted completely into the first cavity 13A, the second detecting surface 18B of the second detecting portion 17B contacts the upper surface of the first body 61A to form a clearance between the first and second facing surfaces 11A, 11B and to restrict the entrance of the second detecting portion 17B into the first recess 21A. Similarly, if the second terminal fitting 60B is not inserted completely into the second cavity 13B, as shown in FIG. 4, the first detecting surface 18A of the first detecting portion 17A contacts the lower surface of the second body 61B to form a clearance between the second and second facing surfaces 11B, 11B and to restrict the entrance of the first detecting portion 17A into the second recess 21B.

Figure 9:
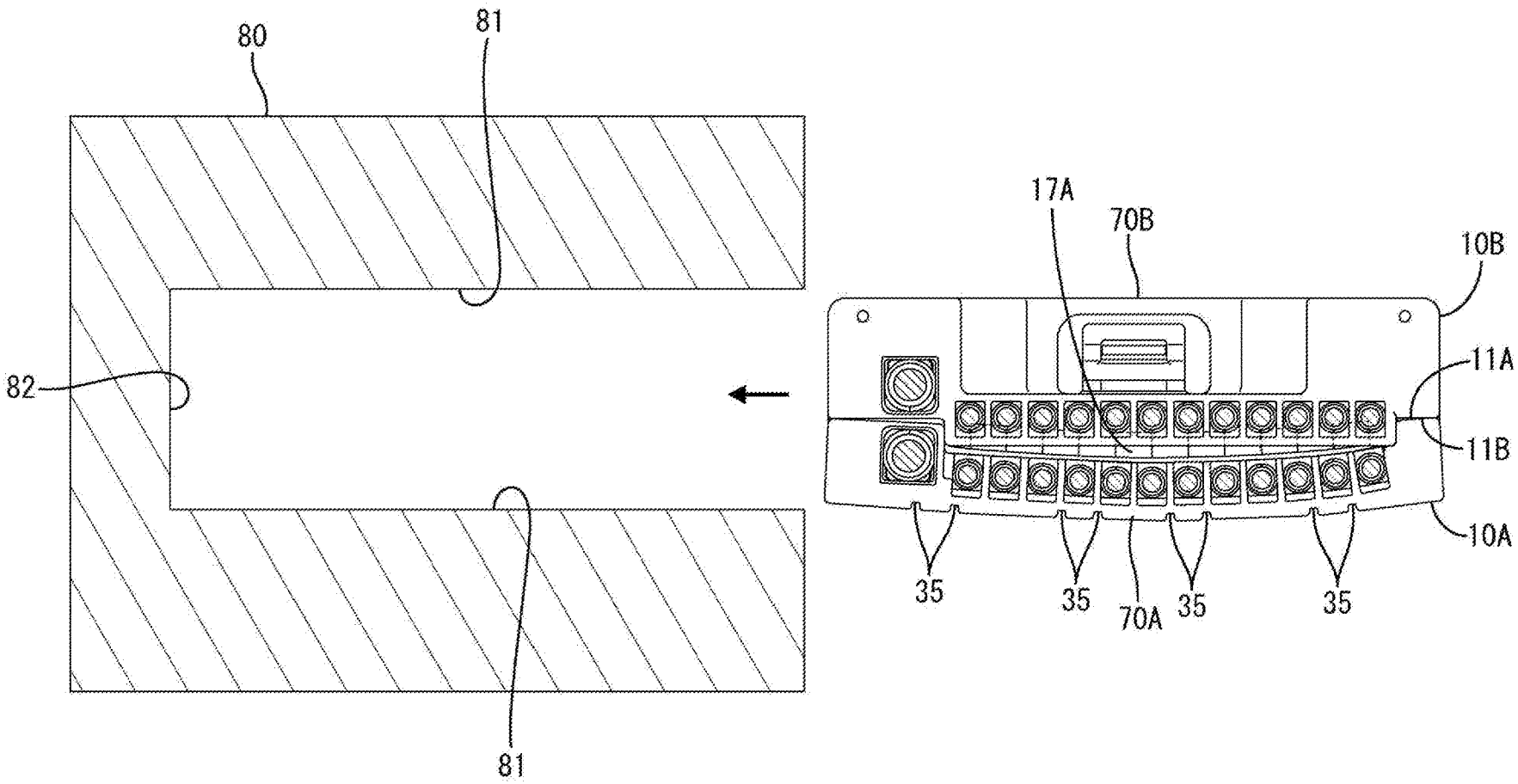
FIG. 9 is a view showing a state where the first detecting portion interferes with the second terminal fitting in the incompletely inserted state and the insertion of the improperly assembled stacked connector into the tool is restricted.

If the first detecting surface 18A of the first detecting portion 17A contacts the lower surface of the second body 61B or the second detecting surface 18B of the second detecting portion 17B contact the upper surface of the first body 61A, a large clearance is formed between the first and second facing surfaces 11A, 11B at that contact position. However, the clearance becomes smaller with distance from the contact position and a locked state of the first and second housing locks 12A, 12B is realized at both widthwise sides. Thus, as shown in FIG. 9, the entire first housing 10A between both widthwise sides (locked positions of the first and second housing locks 12A, 12B) is curved in an arched manner in a front view to bulge to a greatest extent at the contact position with respect to the second housing 10B. The respective grooves 35 recessed in the end surface 34 of the rib 31 widen groove widths thereof to enable the curved deformation of the first housing 10A.

As shown in FIG. 3, with the second detecting portions 17B fit in the first recesses 21A and the first detecting portions 17A fit in the second recesses 21B, the first and second facing surfaces 11A, 11B face each other without any clearance therebetween, a first reference surface 70A (end surface 34, the outer side surface on the lower side of the first housing 10A) constituting the lower surfaces of the rib 31 and the respective crossing ribs 32 is arranged horizontally along the width direction except at the respective grooves 35 and a second reference surface 70B (outer surface on the upper side of the first housing 10A) constituting the upper surface of the covering wall 39 is arranged horizontally over the entire width direction. Thus, a vertical distance between the first and second reference surfaces 70A, 70B is kept at a constant predetermined value along the width direction. A tool 80 shown in FIGS. 8 and 9 can be used to confirm that the vertical distance between the first and second reference surfaces 70A, 70B is kept at the predetermined value.

The tool 80 includes two flat walls 81 arranged in parallel while being separated by a distance corresponding to the predetermined value and a back wall 82 linking rear ends of the flat walls 81 to define a U-shape.

Figure 8:
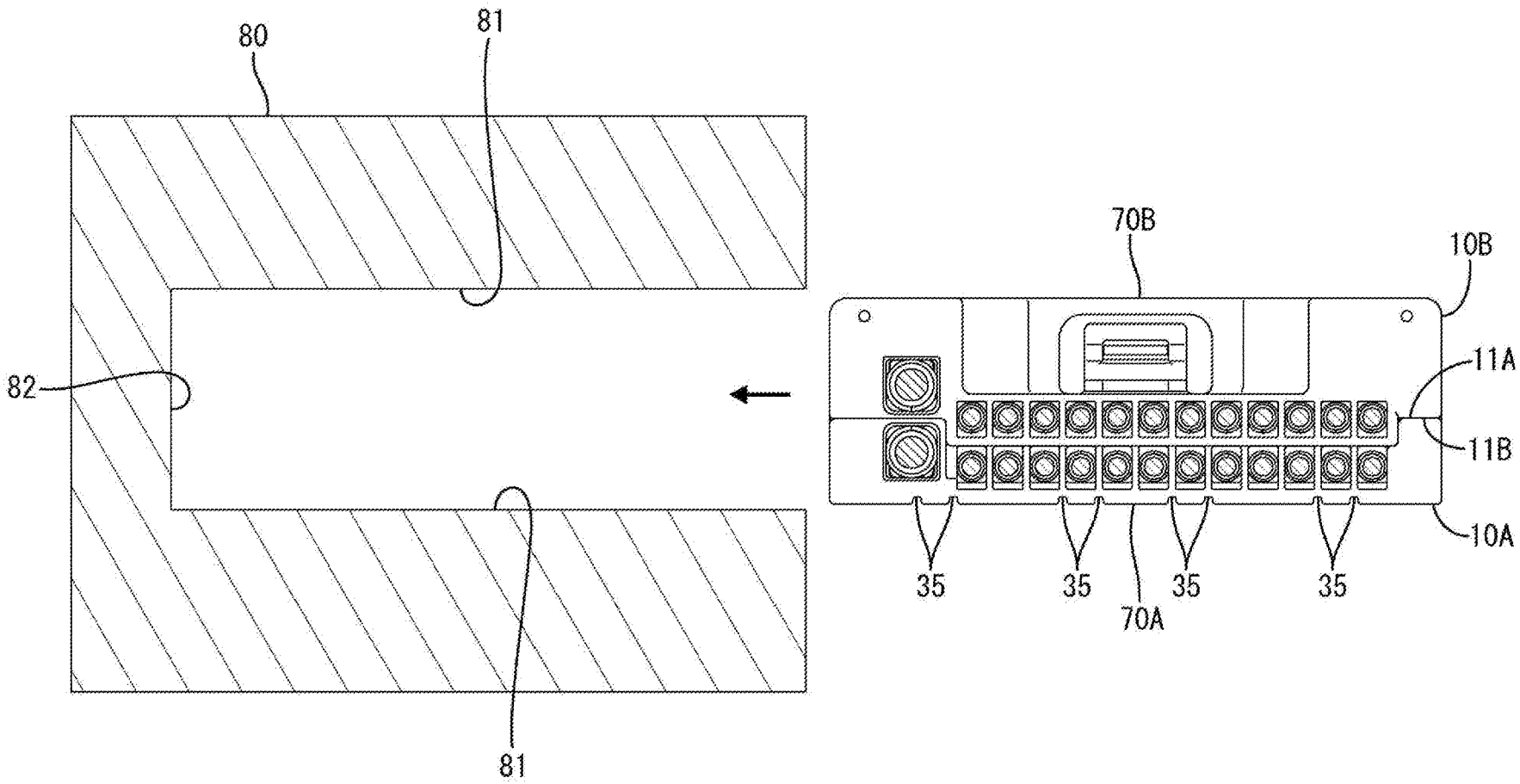
FIG. 8 is a view showing a state where the insertion of the properly assembled stacked connector into a tool is allowed.

As shown in FIG. 8, the first and second reference surfaces 70A, 70B are parallel to each other. If the stacked connector (first and second united housings 10A, 10B) is inserted into the tool 80 along a direction of an arrow of FIG. 8 when the vertical distance between the first and second reference surfaces 70A, 70B is the predetermined value, the first and second reference surfaces 70A, 70B can respectively face and contact the corresponding flat surfaces 81. Thus, the stacked connector can be inserted into the tool 80 to a proper depth to confirm that the vertical distance between the first and second reference surfaces 70A, 70B is the predetermined value and that the first and second terminal fittings 60A, 60B are inserted respectively properly in the first and second cavities 13A, 13B.

On the other hand, if the second detecting portion 17B is in contact with the upper surface of the incompletely inserted first terminal fitting 60A or the first detecting portion 17A is in contact with the lower surface of the incompletely inserted second terminal fitting 60B, a clearance is formed between the first and second facing surfaces 11A, 11B. Thus, as described above, the first housing 10A is curved in an arched manner with respect to the second housing 10B. More particularly, the first reference surface 70A (outer side surface on the lower side of the first housing 10A) bulges away from the second reference surface 70B while the respective grooves 35 are deformed. The second reference surface 70B is maintained in a state horizontally arranged over the entire width.

In this case, the vertical distance between the first and second reference surfaces 70A, 70B exceeds the predetermined value in a bulging region of the first reference surface 70A, as shown in FIG. 9. Thus, the stacked connector cannot be inserted between the two flat surfaces 81 corresponding to the predetermined value. An inability to insert the stacked connector into the tool 80 indicates that the vertical distance between the first and second reference surfaces 70A, 70B exceeds the predetermined value and that at least one of the first and second terminal fittings 60A, 60B is not inserted completely.

As described above, the grooves 35 are provided in the first reference surface 70A of the first housing 10A, and the first housing 10A can be curved and deformed in the width direction via the respective grooves 35 when any one of the first and second terminal fittings 60A, 60B is inserted incompletely. Thus, the insertion of the stacked connector into the tool 80 is restricted. As a result, reliability in detecting incomplete insertion is enhanced.

The grooves 35 are provided at intervals in the width direction in the end surface 34 so that, the first housing 10A is deformed easily. As a result, an incomplete insertion of a first or second terminal fitting 60A, 60B at any position in the width direction of the first and second housings 10A, 10B will restrict insertion of the stacked connector into the tool 80, thereby reliably detecting the incomplete insertion of at least one of the first and second terminal fittings 60A, 60B.

Other embodiments are briefly described below.

The stacked connector may be configured by stacking three or more housings including a pair of housings (first housing and second housing).

Grooves also may be provided in the outer side surface (upper surface) of the second housing in addition to the first housing, and both the first and second housings may be resiliently deformable.

Grooves may be provided only in the outer side surface (upper surface) of the second housing without being provided in the first housing, and only the second housing may be resiliently deformable.

A groove may be recessed only at one position of the outer surface of at least one of the first and second housings.

The grooves may be recessed over the entire length in a depth direction in the outer surface of at least one of the first and second housings without being recessed on the rib projecting on the outer side surface.

At least one of the first and second housings may have a function of detecting an incompletely inserted state of the first or second terminal fittings in the other housing, and either the first detecting portions or the second detecting portions may be omitted.

LIST OF REFERENCE SIGNS

10A . . . first housing
10B . . . second housing
11A . . . first facing surface
11B . . . second facing surface
13A . . . first cavity
13B . . . second cavity
17A . . . first detecting portion
17B . . . second detecting portion
31 . . . rib
35 . . . groove
70A . . . first reference surface
70B . . . second reference surface

What is claimed is:

1. A stacked connector, comprising:

a first housing and a second housing to be stacked in a stacking direction, each of the first and second housings having first and second opposed walls, a facing surface formed on the first wall and facing the other of the first and second housings in the stacking direction, at least one cavity formed in each of the first and second housings and extending in an insertion direction, the at least one cavity configured to receive a terminal fitting;

at least one detecting portion formed on at least one of the first and second housings and projecting toward the at least one of cavity of the other of the first and second housings and configured to detect the terminal fitting incompletely inserted into the cavity; and at least one of the first and second housings is recessed with at least one groove formed in an outer surface of the second wall opposite to the facing surface by cutting a region along a width direction intersecting the stacking direction, the groove extending in the insertion direction intersecting the stacking direction and the width direction, the groove being open on both sides in the insertion direction.

2. The stacking connector of claim 1, wherein the region is a rib extending in the width direction, and the at least one groove comprises a plurality of the grooves provided at intervals in the width direction on an outer side surface of the rib.

3. The stacking connector of claim 1, wherein the at least one groove formed on at least one of the first and second housings widens in the width direction when the at least one detecting portion contacts the terminal fitting, and portions of at least one of the first and second housings bulge away from the other of the first and second housing in the stacking direction.

* * * * *